US011033162B1

(12) United States Patent
Bosses

(10) Patent No.: US 11,033,162 B1
(45) Date of Patent: Jun. 15, 2021

(54) VACUUM CLEANER HAVING FLEXIBLE VENT MEMBERS

(71) Applicant: Zenith Technologies, LLC, Fort Lauderdale, FL (US)

(72) Inventor: Mark D Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 0 days.

(21) Appl. No.: 16/712,735

(22) Filed: Dec. 12, 2019

(51) Int. Cl.
*A47L 9/00* (2006.01)
*A47L 9/02* (2006.01)
*A47L 9/04* (2006.01)

(52) U.S. Cl.
CPC ..... *A47L 9/0072* (2013.01); *A47L 9/0477* (2013.01)

(58) Field of Classification Search
CPC ..... Y10T 137/788–7891; A47L 5/30; A47L 9/0072; A47L 9/02; A47L 9/0416; A47L 9/0477
USPC ..... 137/852–855; 15/373, 416, 418, 421
See application file for complete search history.

(56) References Cited

U.S. PATENT DOCUMENTS 2,181,594 A * 11/1939 Bjorkman ..... A47L 9/02 15/418
2,561,964 A 7/1951 Anderson
2,585,186 A 2/1952 Taylor
2,659,925 A 11/1953 Wood
2,894,274 A 7/1959 Coons
3,005,224 A 10/1961 Magarian
3,277,512 A 10/1966 Waters
4,091,496 A 5/1978 Desrosiers et al.
4,499,628 A 2/1985 Platt
5,265,305 A 11/1993 Kraft et al.
5,285,547 A 2/1994 Sebor
6,018,845 A 2/2000 Sueki et al.
7,278,181 B2 10/2007 Harris et al.
7,331,360 B2 * 2/2008 Camis, Jr. ..... F16K 15/144 137/512.3
7,409,742 B2 8/2008 Song et al.
8,424,156 B2 4/2013 Hsu
9,027,203 B2 5/2015 Conrad et al.
9,770,148 B2 * 9/2017 Bosses ..... A47L 9/0477
2006/0277713 A1 12/2006 Sandlin et al.
(Continued)

FOREIGN PATENT DOCUMENTS

DE 202004012610 U1 12/2005
JP S54-9573 U 1/1979
(Continued)

*Primary Examiner* — Joseph J Hail
*Assistant Examiner* — Arman Milanian
(74) *Attorney, Agent, or Firm* — Global IP Counselors, LLP

(57) ABSTRACT

A vacuum cleaner basically includes a base, a motor, first and second inlets, and first and second flexible members. The motor is configured to create flow through a suction path. The first inlet and the second inlet are disposed in the base in fluid communication with the suction path. The first flexible member and the second flexible member are connected to the base to cover the second inlet. The first and second flexible members are movable between first positions in which the second inlet is substantially covered to substantially prevent fluid from flowing through the second inlet and second positions in which fluid is allowed to flow through the second inlet.

20 Claims, 6 Drawing Sheets

(56) References Cited

U.S. PATENT DOCUMENTS

| | | | | |
|---|---|---|---|---|
| 2011/0131757 | A1 | 6/2011 | Heed | |
| 2012/0227211 | A1* | 9/2012 | Hwang | A47L 9/0483 15/415.1 |
| 2012/0233806 | A1 | 9/2012 | Streciwilk | |
| 2012/0285394 | A1 | 11/2012 | Freidell | |
| 2015/0101144 | A1 | 4/2015 | Bosses | |
| 2016/0256024 | A1* | 9/2016 | Kettle Aiers | A47L 9/0477 |
| 2019/0090704 | A1* | 3/2019 | Bosses | A47L 9/0416 |

FOREIGN PATENT DOCUMENTS

| | | | |
|---|---|---|---|
| JP | S63-181724 | A | 7/1988 |
| JP | H11-206642 | A | 8/1999 |
| JP | H11-309096 | A | 11/1999 |
| JP | 2002-000512 | A | 1/2002 |

* cited by examiner

VACUUM CLEANER HAVING FLEXIBLE VENT MEMBERS

BACKGROUND

Field of the Invention

This invention generally relates to a vacuum cleaner. More specifically, the present invention relates to a vacuum cleaner having flexible vent members.

Background Information

Vacuum cleaners typically use a suction nozzle that is movable across a surface to be cleaned. The suction created at an inlet in the nozzle results in the removal of free dirt particles accumulated on the surface. However, ground-in dirt is frequently encountered when cleaning carpets or other textured surfaces, and reliance on suction for removal of such ground-in dirt has proven to be unsatisfactory.

Vacuum cleaners are provided with devices that agitate the carpet surface to dislodge ingrained dirt particles. For example, mechanical beaters physically strike the carpet surface to loosen dirt particles. Such agitators are often located on the vacuum cleaner nozzle head, so that dirt can be dislodged and instantly removed by moving the nozzle head across a soiled carpet surface. An example of a mechanical beater is a cylindrical rotatable beater brush having a plurality of extending resilient bristles and prongs that physically beat the carpet as the nozzle head is moved.

A recent trend in carpet manufacturing is soft carpets, which are made of softer yarns. Denier quantifies the softness of the yarn, and is the weight in grams of 9,000 meters of the yarn. The larger the denier, the thicker the yarn. Denier per filament (DPF) represents the size of an individual filament of the yarn. The lower the DPF, the softer the fiber. Traditional home carpets have a DPF of between approximately 12 to 18 DPF. The new soft carpet trend has resulted in carpets having a DPF between approximately 3.5 to 4.5 DPF. These soft yarns can have three to four times as many filaments as in the traditional home carpets. Traditional strands of yarn have approximately 120 filaments. The soft strands of yarn can have approximately 700 or more filaments.

SUMMARY

Generally, the present disclosure is directed to various features of a vacuum cleaner in one feature, a vacuum cleaner is provided having; flexible vent members.

In view of the state of the know technology and in accordance with a first aspect of the present disclosure, a vacuum cleaner is basically provided with a base, a motor, first and second inlets, and first and second flexible members. The motor is configured to create flow through a suction path. The first inlet and the second inlet are disposed in the base in fluid communication with the suction path. The first flexible member and the second flexible member are connected to the base to cover the second inlet. The first and second flexible members are movable between first positions in which the second inlet is substantially covered to substantially prevent fluid from flowing through the second inlet and second positions in which fluid is allowed to flow through the second inlet.

In accordance with a second aspect of the present invention, the vacuum cleaner according to the first aspect is configured such that each of the first and second flexible members has a fixed end and a free end, and the free ends of the first and second flexible members contacting each other in the first positions.

In accordance with a third aspect of the present invention, the vacuum cleaner according to the second aspect is configured such that the first and second flexible members are movable to the second positions upon a suction force being exerted on the first and second flexible members causing movement thereof.

In accordance with a fourth aspect of the present invention, the vacuum cleaner according to the first aspect is configured such that the first and second flexible members are made of a material selected from the group consisting of silicone, rubber, neoprene and polyurethane.

In accordance with a fifth aspect of the present invention, the vacuum cleaner according to the first aspect is configured such that each of the first and second flexible members has a Shore A durometer between approximately 10 and approximately 90.

In accordance with a sixth aspect of the present invention, the vacuum cleaner according to the first aspect is configured such that the first and second flexible members are substantially identical.

In accordance with a seventh aspect of the present invention, the vacuum cleaner according to the first aspect is configured such that a third inlet is disposed in the base in fluid communication with the suction path, and a third flexible member and a fourth flexible member are connected to the base to cover the third inlet, the third and fourth flexible members being movable between first positions in which the third inlet is substantially covered to substantially prevent fluid from flowing through the third inlet and second positions in which fluid is allowed to flow through the third inlet.

In accordance with an eighth aspect of the present invention, the vacuum cleaner according to the seventh aspect is configured such that the first, second, third and fourth flexible members are substantially identical.

In accordance with a ninth aspect of the present invention, the vacuum cleaner according to the second aspect is configured such that a surface agitator is rotatably disposed in the base.

In accordance with a tenth aspect of the present invention, the vacuum cleaner according to the ninth aspect is configured such that the first and second flexible members are disposed forward of the surface agitator in a longitudinal direction of the base.

In view of the state of the known technology and in accordance with an eleventh aspect of the present disclosure, a vacuum cleaner is basically provided with a housing, a suction path, a base, a motor, first and second inlets, and first and second flexible members. The suction path is in fluid communication with the housing. The motor is configured to create flow through the suction path. The first inlet and the second inlet are disposed in the base in fluid communication with the suction path. The second inlet is disposed forward of the first inlet in a longitudinal direction of the base. The first flexible member and the second flexible member are connected to the base to cover the second inlet. The first and second flexible members are movable between first positions in which the second inlet is substantially covered to substantially prevent fluid from flowing through the second inlet and second positions in which fluid is allowed to flow through the second inlet.

In accordance with a twelfth aspect of the present invention, the vacuum cleaner according to the eleventh aspect is configured such that the first and second flexible members are movable to the second positions upon a suction force being exerted on the first and second flexible members causing movement thereof.

In accordance with a thirteenth aspect of the present invention, the vacuum cleaner according to the eleventh aspect is configured such that the base includes a frame and a cover plate connected to the frame, the second inlet being defined between the cover plate and the frame.

In accordance with a fourteenth aspect of the invention, the vacuum cleaner according to the thirteenth aspect is configured such that no portion of the frame is disposed directly beneath the second inlet.

In accordance with a fifteenth aspect of the invention, the vacuum cleaner according to the thirteenth aspect is configured such that the first flexible member is connected to the frame, and the second flexible member is connected to the cover plate.

In accordance with a sixteenth aspect of the invention, the vacuum cleaner according to the eleventh aspect is configured such that each of the first and second flexible members has a fixed end and a free end, the free ends of the first and second flexible members contacting each other in the first positions.

In accordance with a seventeenth aspect of the present invention, the vacuum cleaner according to the eleventh aspect is configured such that the first and second flexible members are made of a material selected from the group consisting of silicone, rubber, neoprene and polyurethane.

In accordance with an eighteenth aspect of the present invention, the vacuum cleaner according to the eleventh aspect is configured such that each of the first and second flexible members has a Shore A durometer between approximately 10 and approximately 90.

In accordance with a nineteenth aspect of the present invention, the vacuum cleaner according to the eleventh aspect is configured such that the first flexible member is configured to pivot in a first pivot direction and the second flexible member is configured to pivot in a second pivot direction, the second pivot direction being opposite the first pivot direction.

In accordance with a twentieth aspect of the present invention, the vacuum cleaner according to the eleventh aspect is configured such that the first flexible member contacts the second flexible member when the first and second flexible members are in the first positions.

Also, other objects, features, aspects and advantages of the disclosed vacuum cleaner will become apparent to those skilled in the art from the following detailed description, which, taken in conjunction with the annexed drawings, discloses exemplary embodiments of the vacuum cleaner.

BRIEF DESCRIPTION OF THE DRAWINGS

Referring now to the attached drawings which form a part of this original disclosure.

Throughout the drawing figures, like reference numerals will be understood to refer to like parts, components and structures.

DETAILED DESCRIPTION OF EXEMPLARY EMBODIMENTS

Selected exemplary embodiments will now be explained with reference to the drawings. It will be apparent to those skilled in the art from this disclosure that the following descriptions of the exemplary embodiments are provided for illustration only and not for the purpose of limiting the invention as defined by the appended claims and their equivalents.

Figure 1:
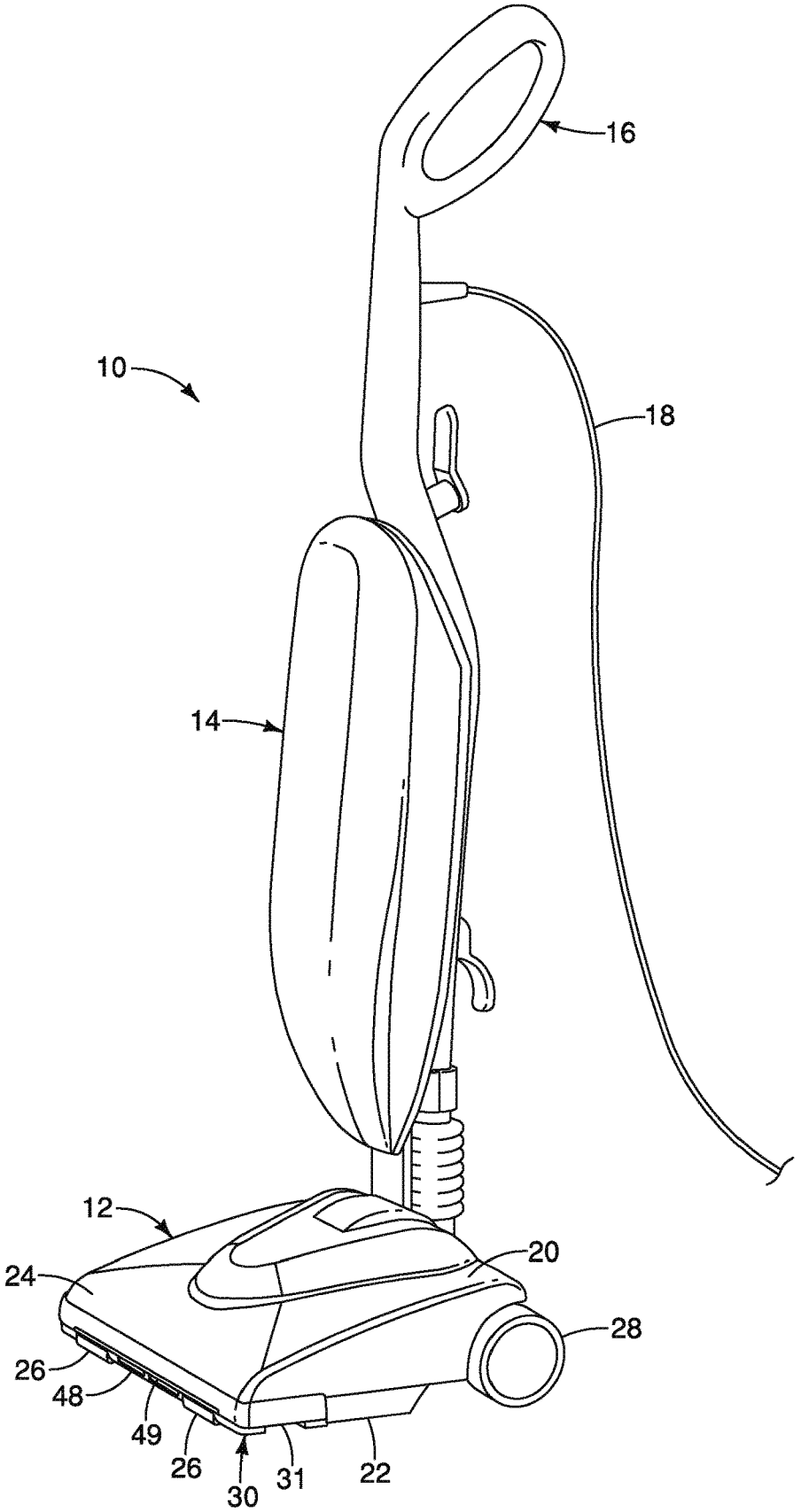
FIG. 1 is a perspective view of a vacuum cleaner in accordance with an exemplary embodiment of the present invention.

As shown in FIG. 1, a vacuum cleaner 10 in accordance with an exemplary embodiment of the present invention includes a suction head or base 12, a housing 14 for receiving debris, a handle 16, and a power cord 18 for connecting the vacuum cleaner 10 to a source of electrical power. The housing 14 can be, for example, a bag housing or any other suitable apparatus for receiving dirt, dust and other debris collected during operation of the vacuum cleaner 10. The vacuum cleaner 10 can be any suitable type of vacuum cleaner, such as, but not limited to, a direct air and bypass air upright vacuum cleaner, a canister vacuum cleaner, a stick vacuum cleaner, and a multi-surface vacuum cleaner. The various components and interactions of the vacuum cleaner 10 would be understood by one of ordinary skill in the art.

The base 12 includes a top surface 20 and a lower surface 22. The top surface 20 includes a front portion 24, which may be curved as best shown in the exemplary embodiment of FIGS. 1 to 9. A set of front wheels 26 and a set of rear wheels 28 are rotatably connected to the base 12. The front wheels 26 are rotatable about a first rotation axis R1 and the rear wheels 28 are rotatable about a second rotation axis R2, as shown in FIG. 3. The first and second rotation axes R1 and R2 extend in a lateral (left-to-right) direction of the vacuum cleaner 10. The first and second rotation axes R1 and R2 are substantially parallel to one another. The first and second rotation axes R1 and R2 extend substantially perpendicularly to a longitudinal (front-to-back) direction of the vacuum cleaner 10. The front and rear wheels 26 and 28 facilitate pushing and pulling the vacuum cleaner 10 during operation. In an exemplary embodiment, as shown in FIG. 8, the front wheels 26 have an increased width and the rear wheels 28 have an increased diameter, respective to each other, to help reduce friction and to allow the vacuum cleaner 10 to be used with a variety of carpet types.

The base 12 includes a frame 31 and a cover plate 30 connected to the frame 31. The cover plate 30 is connected to a lower surface of the frame 31, as shown in FIGS. 1-9. The cover plate 30 has a plurality of fastener openings 34 to receive fasteners connecting the cover plate 30 to the frame 12. The front wheels 26 can be connected to the cover plate 30, as shown in FIG. 8, or directly to the frame 12. As shown in FIG. 8, the cover plate 30 preferably includes bearing housings 36 for receiving the front wheels 26.

Figure 8:
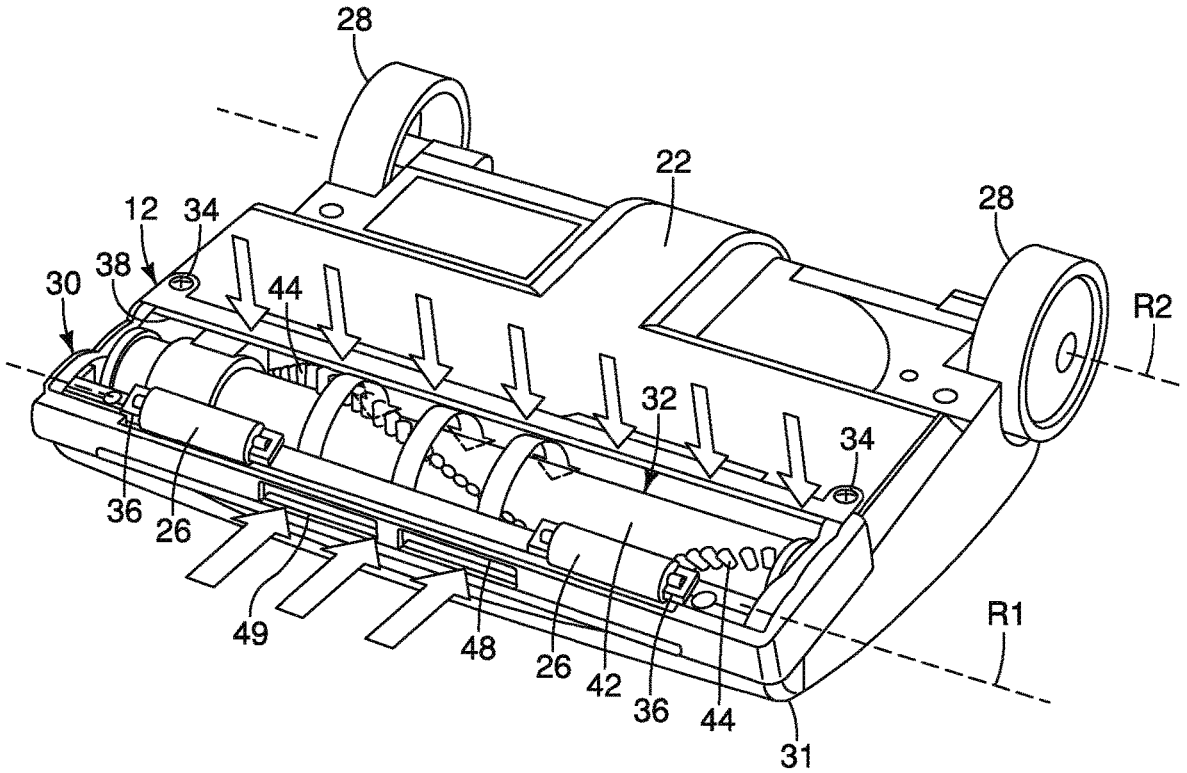
FIG. 8 is a lower perspective view of the base of the vacuum cleaner of FIG. 1.
Figure 9:
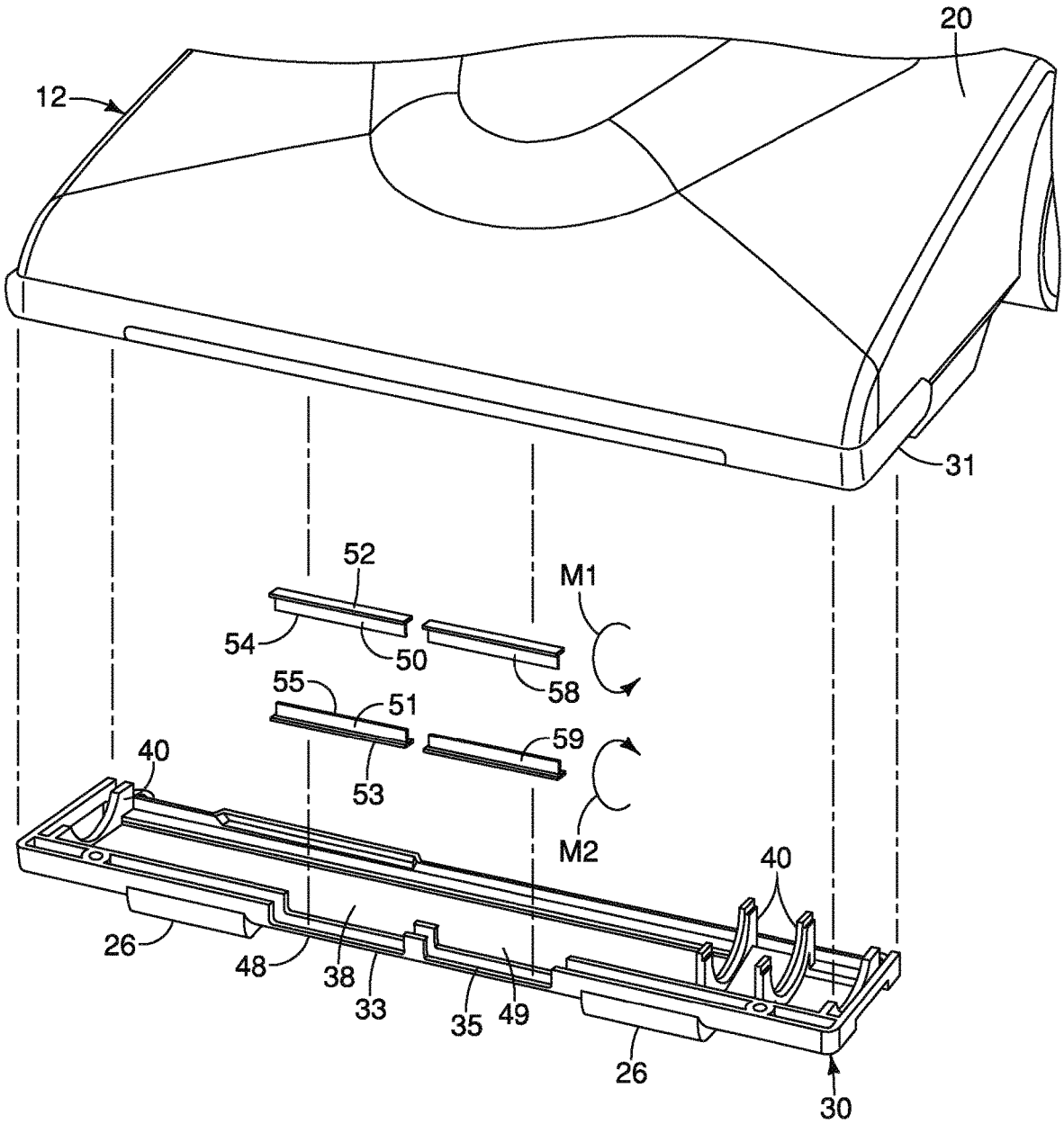
FIG. 9 is an exploded assembly view of the base of the vacuum cleaner of FIG. 1.

A surface agitator, such as a brush roll 32, is connected to the lower surface 22 of the frame 31, as shown in FIGS. 8 and 9. The surface agitator, such as the brush roll 32, is movably disposed in the base 12. In an exemplary embodiment, the cover plate 30 secures the brush roll 32 to the base 12. The cover plate 30 also includes an opening 38 for receiving the brush roll 32. A plurality of support members 40 extend across the opening 38 to facilitate supporting the brush roll 32. The support members 40 preferably extend in a direction parallel to a longitudinal, or front-to-rear, direction of the vacuum cleaner. The brush roll 32 is a rotating cylinder 42 having a helical bristle 44 extending from the cylinder. Different types of brush rolls 32 or other carpet agitators may be used in place of, or in addition to, the cover plate 30.

Figure 5:
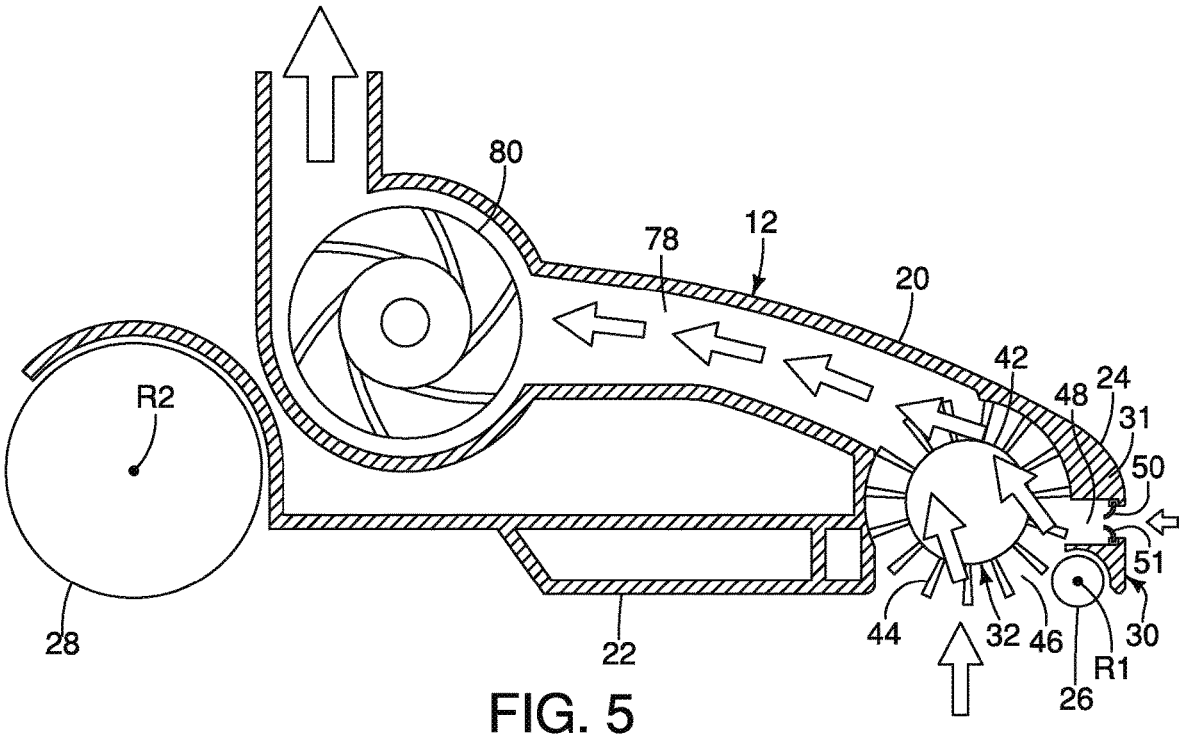
FIG. 5 is a side elevational view in cross section of the base of the vacuum cleaner of FIG. 4.

As best shown in FIG. 5, the opening 38 in the cover plate 30 acts as a first inlet, or suction, inlet 46. Depending on the cover plate 30, the base 12, and the intended use of the vacuum cleaner 10, more air flow inlets may also be provided, including various apertures or slots.

The vacuum cleaner 10 includes a second inlet, or vent, 48. The second inlet 48 acts as a second air inlet in addition to the air inlet provided in the first inlet 46. The second inlet 48 is positioned in the base 12, as shown in FIGS. 1-9. As shown in FIGS. 3, 5 and 7, the second inlet 48 is preferably substantially perpendicular to the first inlet 46. As shown in FIG. 9, the second inlet 48 is preferably defined between the cover plate 30 and the frame 31. A recess 33 is formed in the cover plate 30, as shown in FIG. 9. The second inlet 48 is preferably defined by the recess 33 and the lower surface of the frame 31. As shown in FIGS. 3 and 9, for example, no portion of the frame 31 is disposed directly below the second inlet 48.

First and second flexible vent members, or flexible members, 50 and 51 are movably disposed in the second inlet 48, as shown in FIGS. 3, 5 and 7, to control the flow of fluid through the second inlet 48. The first and second flexible vent members 50 and 51 are fixedly connected to the base 12, as shown in FIG. 9. The first and second flexible vent members 50 and 51 have fixed ends 52 and 53, respectively, connected to the base 12 and free ends 54 and 55 disposed outwardly from the fixed ends 52 and 53. The free ends 54 and 55 of the first and second flexible vent members 50 and 51 contact each oilier when the first and second flexible members 50 and 51 are in the first, or closed, positions, as shown in FIG. 3.

Figure 2:
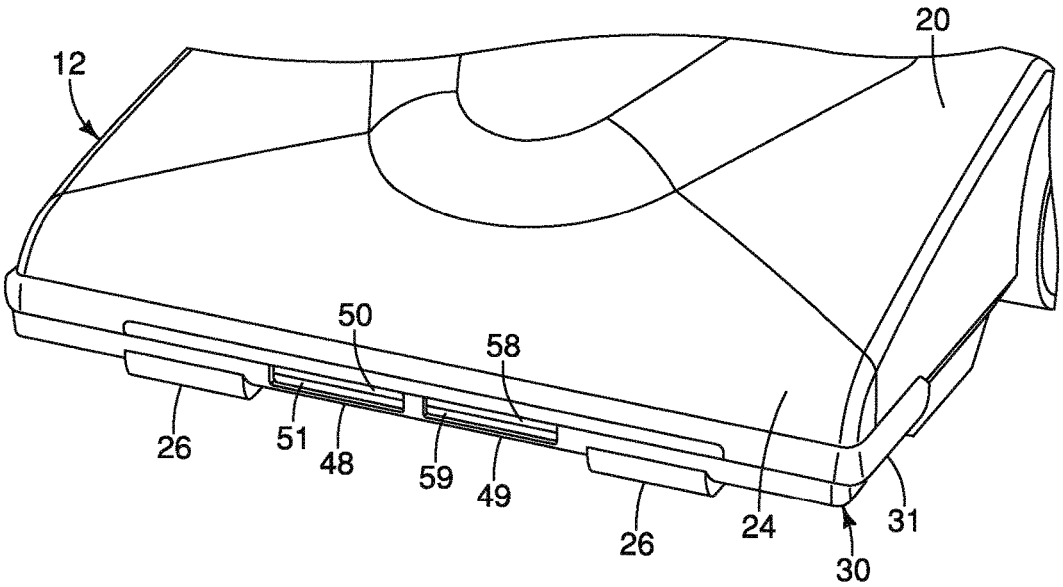
FIG. 2 is a perspective view of a base of the vacuum cleaner of FIG. 1 with first and second flexible members in a closed position.
Figure 3:
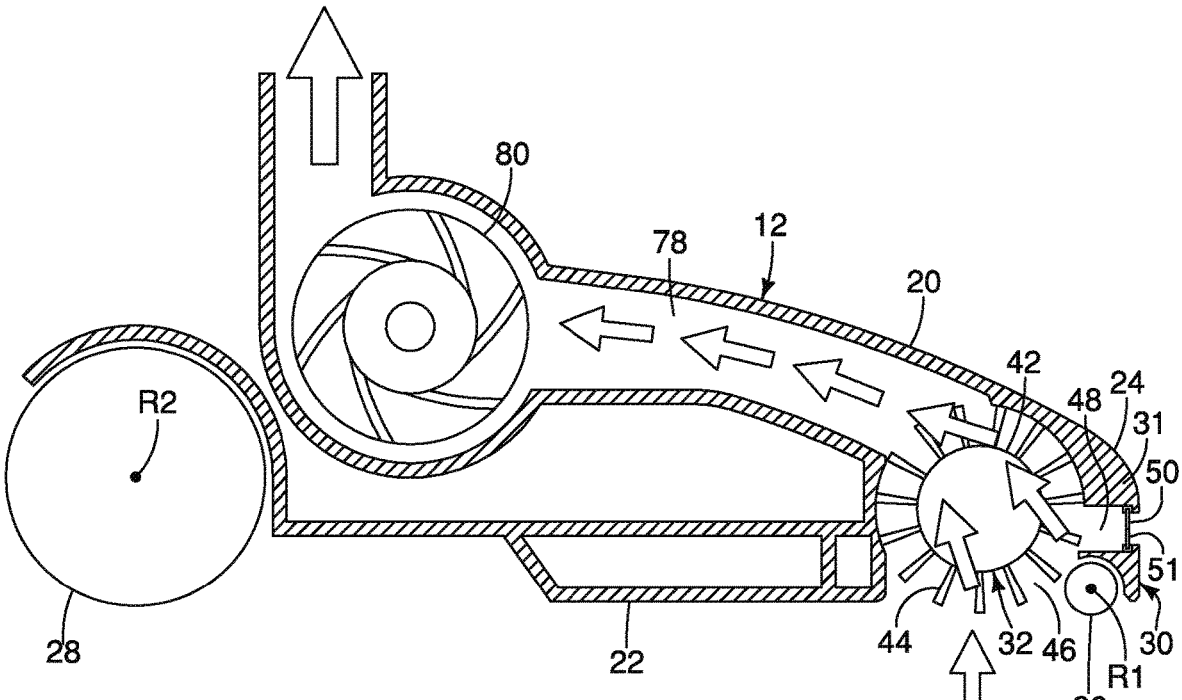
FIG. 3 is a side elevational view in cross section of the base of the vacuum cleaner of FIG. 2.
Figure 4:
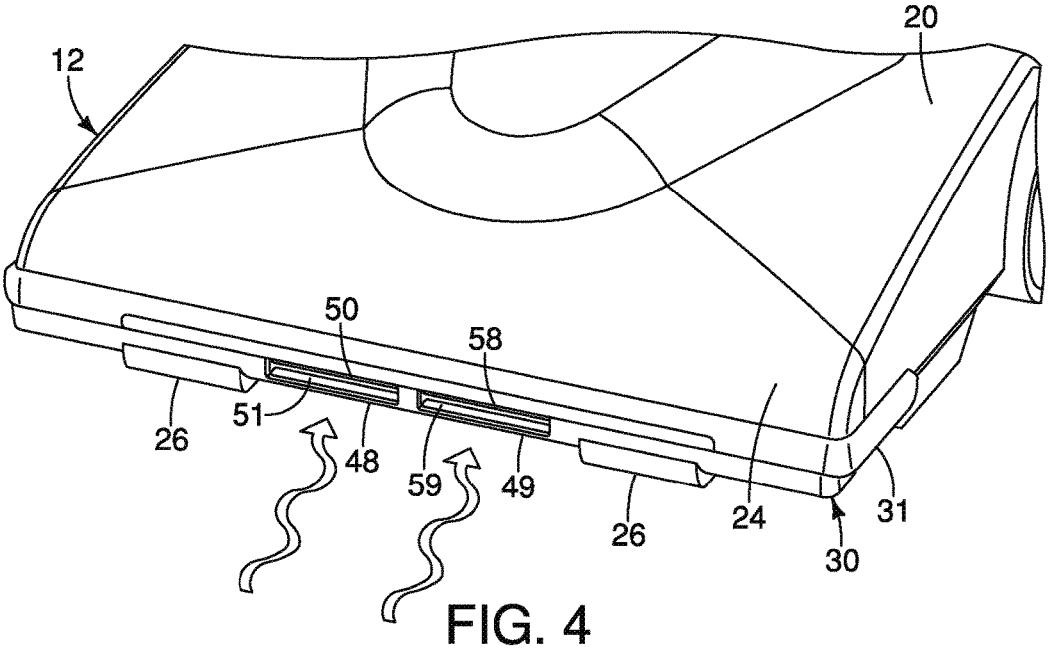
FIG. 4 is a perspective view of the base of the vacuum cleaner of FIG. 1 with the first and second flexible members in a partially opened position.
Figure 6:
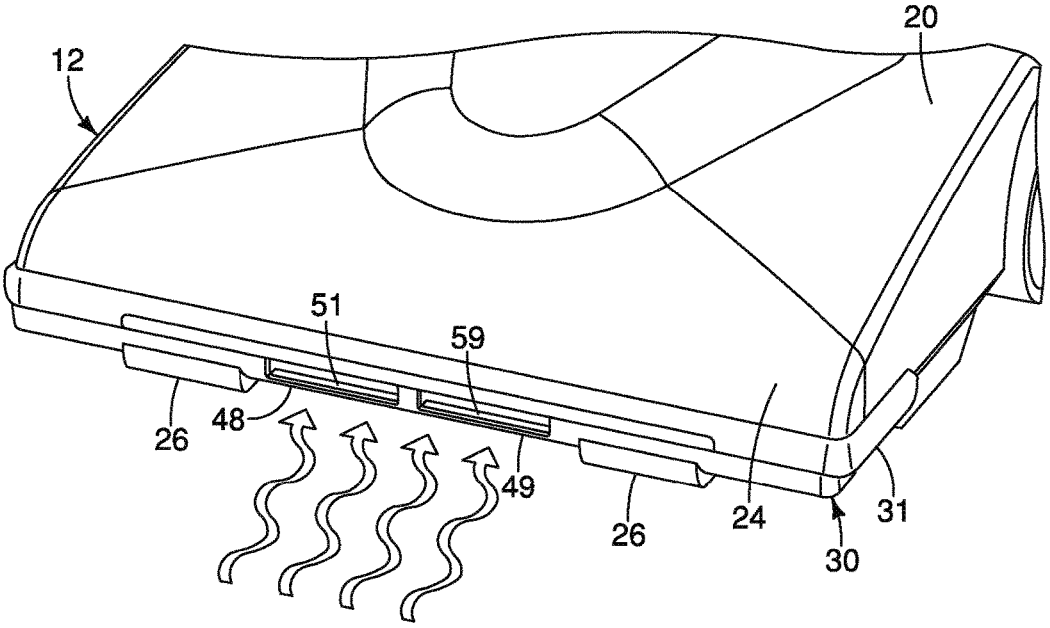
FIG. 6 is a perspective view of the base of the vacuum cleaner of FIG. 1 with the flexible members in a fully opened position.
Figure 7:
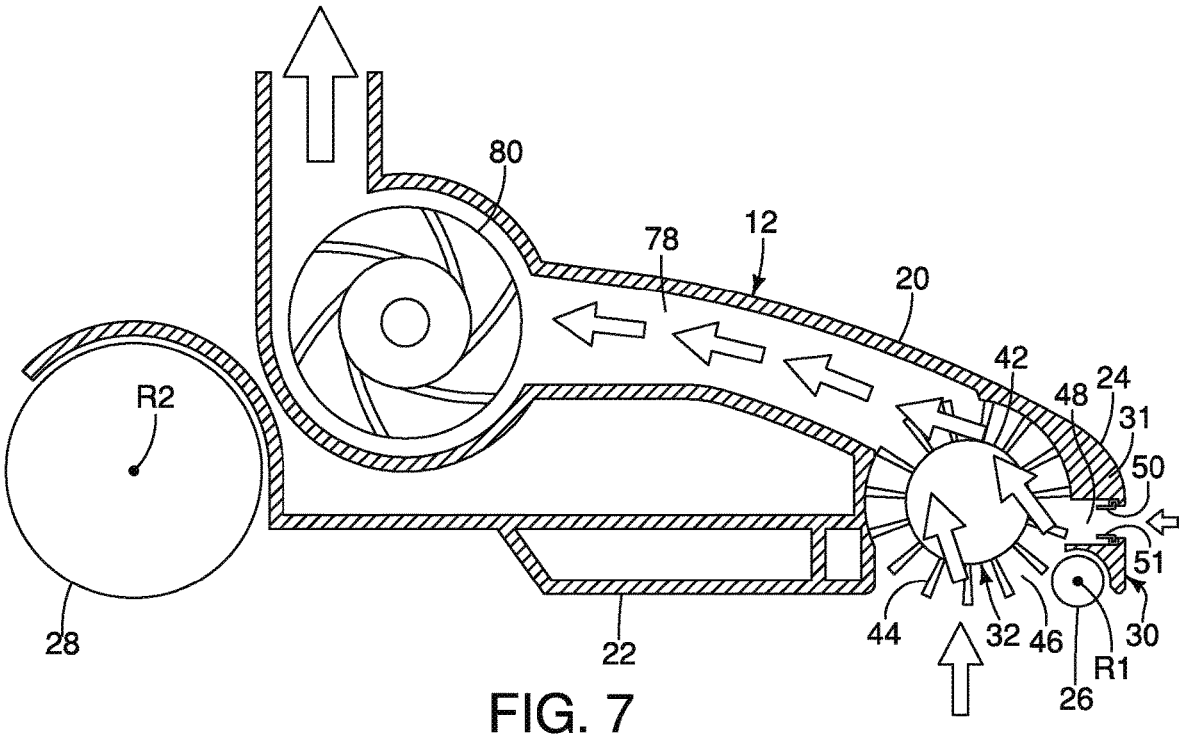
FIG. 7 is a side elevational view in cross section of the base of the vacuum cleaner of FIG. 6.

The first and second flexible vent members 50 are 51 are movable between the first, or closed, positions, as shown in FIGS. 2 and 3, and a second, or opened, positions, as shown in FIGS. 4-7. FIGS. 6 and 7 illustrate the first and second flexible members 50 and 51 in fully opened positions. FIGS. 4 and 5 illustrate the first and second flexible vent members 50 and 51 in partially opened positions between the closed positions of FIGS. 2 and 3 and the fully opened positions of FIGS. 6 and 7.

The fixed end 52 of the first flexible vent member 50 is fixedly connected to the lower surface of the frame 31 of the base 12, as shown in FIGS. 3 and 9. The fixed end 53 of the second flexible vent member 51 is fixedly connected to the recess 33 of the cover plate 30. The fixed ends 52 and 53 of the first and second flexible vent members 50 and 51 are connected to the base 12 in any suitable manner, such as with a fastener or adhesive. Alternatively, the flexible vent members 50 and 51 can be slid into a slot or other suitable receiving member in the frame 12 and the cover plate 30, such that the flexible vent members 50 can be easily installed and replaced. The first flexible vent member 50 extends toward the second flexible member 51 in the first position, as shown in FIG. 3. As shown in FIGS. 3 and 9, the free ends 54 and 55 contact each other when the first and second flexible vent members 50 and 51 are in the first positions to substantially cover the second inlet 48 to substantially prevent fluid from flowing therethrough. Alternatively, the free end of one of the flexible vent members 50 and 51 can overlap the free end of the other flexible vent member such that the second inlet 48 is closed to prevent fluid from flowing, therethrough. Alternatively, a slight gap can be formed between the free ends 54 and 55 of the first and second flexible vent members 50 and 51.

The first and second flexible members 50 and 51 are preferably substantially, rectangular, ss shown in FIG. 9, The first and second flexible members 50 and 51 can be longer than the second inlet 48, such that the lateral ends of the first and second flexible members 50 and 51 extend beyond the lateral ends of the second inlet 48. Alternatively, the lateral ends of the first and second flexible members 50 and 51 contact the lateral ends of the second inlet 48 when the first and second flexible members 50 and 51 are in the closed positions. The first and second flexible members 50 and 51 are preferably substantially identically shaped.

The first flexible member 50 is configured to move in a first movement direction M1 and the second flexible member 51 is configured to move in a second movement direction M2, as shown in FIG. 9. The second movement direction M2 is opposite the first movement direction M1. As shown in FIG. 9, the first flexible member 50 moves in a counterclockwise direction (M1) about the fixed end 52 from the first position (FIG. 3) to the second position (FIGS. 5 and 7). As shown in FIG. 9, the second flexible member 51 moves in a clockwise direction (M2) about the fixed end 53 from the first position (FIG. 3) to the second position (FIGS. 5 and 7). The second movement direction M2 is preferably opposite the first movement direction M1.

When the first and second flexible members 50 and 51 are in the first position, as shown in FIGS. 2 and 3, the second inlet 48 is substantially covered to substantially prevent fluid from flowing through the second inlet 48. The first position corresponds to the first and second flexible members 50 and 51 being in the fully closed position.

When the first and second flexible members 50 and 51 are in the second positions, as shown in FIGS. 4 to 7, fluid is allowed to flow through the second inlet 48. The second position corresponds to a position in which the first and second flexible members 50 and 51 are moved to allow fluid to flow through the second inlet 48. As shown in FIGS. 4 and 5, the first and second flexible members are moved about the fixed ends 52 and 53, respectively, to partially opened positions. As shown in FIGS. 6 and 7, the first and second flexible members 50 and 51 are moved about the fixed ends 52 and 53 to fully opened positions. As shown in FIGS. 3, 5 and 7, free ends 54 and 55 of the first and second flexible members 50 and 51 are disposed rearwardly in the second position with respect to the free ends 54 and 55 of the first and second flexible members 50 and 51 in the first position. The first and second flexible members 50 and 51 are positionable in at least one position between the closed positions (FIGS. 2 and 3) and the fully opened positions (FIGS. 6 and 7), such as the partially opened positions shown in FIGS. 4 and 5.

As best shown in FIGS. 3, 5 and 7, the first and second flexible members 50 and 51 are variably positionable to increase the amount of airflow through the second inlet 48.

The first and second flexible members 50 and 51 are movable between closed positions shown in FIGS. 2 and 3, fully opened positions shown in FIGS. 6 and 7, intermediate positions shown in FIGS. 4 and 5, and various other positions therebetween. In an exemplary embodiment, the first and second flexible members 50 and 51 are movable between the first positions in which the first and second flexible members 50 and 51 substantially cover the second inlet 48 to substantially prevent fluid from flowing therethrough and the second positions in which fluid is allowed to flow through the second inlet 48. The first positions, therefore, do not need to fully close the second inlet 48.

Softer carpets have an increased surface area of the fibers, which increases the drag across a surface with the vacuum cleaner. Additionally, the increased surface area increases the difficulty of pulling air through the carpet, which slows down or stops the mechanical beaters, such as the brush roll 32, of the vacuum cleaner. Soft yarn strands also lack the stiffness of traditional carpets, such that vacuum cleaners tend to sink in the soft carpets. The soft yarn strands tend to form a more complete seal around the vacuum cleaner base, thereby increasing suction at the point of contact with the soft carpet surface. The more the vacuum cleaner base sinks into the soft carpet, the greater the suction and the difficulty of operating the vacuum cleaner. Being able to automatically adjust the airflow through the second inlet 48 allows a user to compensate for the issues raised with softer carpets, while also allowing the vacuum cleaner to automatically adjust to different types of carpeted surfaces.

The first and second flexible members 50 and 51 are positioned in the closed positions, as shown in FIGS. 2 and 3. When there is difficulty in drawing air through the first inlet 46, such as when soft yarn strands seal the first inlet 46 as described above, suction is increased in the second inlet 48. When the suction exerted on the first and second flexible members 50 and 51 becomes larger than a predetermined value, the first and second flexible members 50 and 51 are movably drawn to the second positions (FIGS. 4 to 7), thereby allowing fluid to flow through the second inlet 48. The amount of suction exerted on the first and second flexible members 50 and 51 determines the movement amount of the first and second flexible members 50 and 51 such that the greater the suction exerted on the first and second flexible members 50 and 51, the larger the movement amount of the first and second flexible members 50 and 51. The relief of suction to the second inlet 48 clears the seal at the first inlet 46 due to the carpet. As suction is returned to the first inlet 46, the suction at the second inlet 48 is reduced. When the suction at the second inlet 48 becomes less than the predetermined value, the first and second flexible vent members 50 and 51 movably return to the first positions. The hardness of the flexible vent members 50 and 51 can be selected to control the amount of suction required to move the first and second flexible members 50 and 51 during operation of the vacuum cleaner 10. The hardness of the first and second flexible members 50 and 51 can be selected to be larger such that the first and second flexible members 50 and 51 only move when a blockage occurs at the first inlet 46, and the first and second flexible vent members 50 and 51 movably return to the fully closed positions when the blockage is cleared.

When the first and second flexible vent members 50 and 51 are in the fully closed positions, as shown in FIG. 3, such that substantially no fluid flows through the second inlet 48, the entire fluid flow substantially passes through the first inlet 46 in the lower surface 22 of the base 12. When the first and second flexible vent members 50 and 51 are automatically moved to the second positions, as shown in FIGS. 5 and 7, fluid flow is generated through the second inlet 48, thereby relieving suction through the first inlet 46. By relieving the suction through the first inlet 46, the vacuum cleaner 10 becomes easier to push and pull such that the mobility of the vacuum cleaner will be easier for the user. Additionally, slowing down or stopping the brush roll 32 is relieved or eliminated. The additional air path through the second inlet 48 prevents the soft carpet strands from forming a complete seal with the first inlet 46 that can stop operation of the vacuum cleaner 10. By drawing air in through both the first inlet 46 and the second inlet 48, the vacuum cleaner 10 continuously operates when cleaning soft carpets. The second inlet 48 is preferably disposed above the free ends of the carpet strands of the carpet being cleaned, such that the carpet strands do not interfere with the airflow through the second inlet 48.

As best shown in FIGS. 3, 5 and 7, the second inlet 48 directs airflow to the base 12, for example, a bottom region of the base 12 proximate the brush roll 32, for example, in front of the brush roll 32 and the first inlet 46. The second inlet 48 is positioned to receive air from in front of the of the base 12, for example, approximately perpendicular to the longitudinal axis of the brush roll 32 or approximately perpendicular to the airflow of the first inlet 46 or substantially perpendicular to a mean vector of the airflow through the first inlet 46. Depending on the cover plate 30 and the brush roll 32, the flow of fluid through the second inlet 48 may be substantially perpendicular to the airflow through the first inlet 46, as shown in FIGS. 5 and 7. In alternative embodiments, the second inlet 48 can be positioned to provide airflow at other locations of the base 12 or a suction path 78. The second inlet 48 is positioned in the base 12 as close to the surface to be cleaned as possible. This allows for less venting, achieving sufficient suction to perform a cleaning operation on a carpet while still permitting mobility in softer carpets. For example, the second inlet 48 is positioned in the base 12, adjacent the lower surface 22, or positioned in the cover plate 30 positioned below the lower surface 22. In an exemplary embodiment the second inlet 48 is positioned approximately within five inches of a surface to be cleaned. In another exemplary embodiment, the second inlet 48 is positioned approximately within one inch of a surface to be cleaned. As shown in FIGS. 3, 5 and 7, the second inlet 48 is disposed below an uppermost part of the surface agitator, such as the brush roll 32. The second inlet 48 is preferably disposed in front of the surface agitator, such as the brush roll 32, in a lengthwise direction of the base 12 of the vacuum cleaner 10.

A suction motor 80 is disposed in the base 12 of the vacuum cleaner 10, as shown in FIGS. 3, 5 and 7. Alternatively, the suction motor 80 can be disposed elsewhere, for example in the body of the vacuum cleaner 10 or in any other suitable location. The suction motor 80 generates a suction force, as shown in FIGS. 3, 5, 7 and 8, at the first inlet 46 and the second inlet 48 in the base 12, and through a suction path 78. The motor 80 also drives the brush roll 32. Alternatively, a separate motor can be used to drive the brush roll 32.

When powered during operation of the vacuum cleaner 10 and the first and second flexible members 50 and 51 are disposed in the closed positions shown in FIG. 3, air is drawn into the suction path 78 through the first inlet 46 in the lower surface 22 of the base 12. When the first and second flexible vent members 50 and 51 are moved to the second positions, as shown in FIGS. 5 and 7, air is drawn into the suction path 78 through the first inlet 46 and through the second inlet 48. The suction path 78 continues to the filter bag (not shown) to collect dirt and debris. The filter bag can be disposed in the housing 14.

The first and second flexible vent members 50 and 51 are preferably made of silicone, rubber, neoprene or polyurethane, although any suitable material can be used. The flexible vent members 50 and 51 preferably have a Shore A durometer between approximately 10 and approximately 90. The first and second vent members 50 and 51 are preferably substantially identical, although the first and second vent members 50 and 51 can be different materials or have different hardnesses to control and adjust a venting operation of the second inlet 48.

As shown in FIG. 3, for example, each of the first and second flexible vent members 50 and 51 has a height approximately half of the height of the second inlet 48, thereby reducing the overall height of the flexible vent member compared to using only a single cover member to cover the second inlet. As shown in FIG. 9, the height of the second inlet 48 is the distance from the lower surface of the frame 31 of the base 12 to a lower surface of the recess 33 in the cover plate 30 of the base 12. Using upper and lower flexible vent members to cover the second inlet 48, the movement distance of the free ends 54 and 55 of the flexible vent members 50 and 51 into the second inlet 48 is reduced. This configuration allows the surface agitator 32 to be disposed closer to a front interior edge of the suction base 12 because of the reduced height of the first and second flexible vent members 50 and 51. The first and second flexible vent members 50 and 51 do not require mechanical structure, such as a hinge or a spring, to move between the first and second positions, such that there is no mechanical failure associated with the movement of the first and second flexible vent members 50 and 51. Additionally, this reduces the manufacturing cost associated with the first and second flexible vent members 50 and 51.

As shown in FIGS. 1, 8 and 9, a third inlet 49 can be disposed laterally adjacent the second inlet 48. The third inlet 49 is in fluid communication with the suction path 78. The third inlet 49 is preferably substantially identical to the second inlet 48. The third inlet 49 is preferably defined by a recess 35 in the cover plate 30 and the lower surface of the frame 31. As shown in FIG. 9, for example, no portion of the frame 31 is disposed directly below the third inlet 49.

Third and fourth flexible vent members 58 and 59 are connected to the base 12 to cover the third inlet 49. The third and fourth flexible vent members 58 and 59 are movable between first positions in which the third inlet 49 is substantially covered to substantially prevent fluid from flowing through the third inlet 49 and second positions in which fluid is allowed to flow through the third inlet 49. The third and fourth flexible vent members 58 and 59 are substantially identical in structure and operation to the first and second flexible vent members 50 and 51.

The foregoing detailed description of the certain exemplary embodiments has been provided for the purpose of explaining the principles of the invention and its practical application, thereby enabling others skilled in the art to understand the invention for various exemplary embodiments and with various modifications as are suited to the particular use contemplated. This description is not necessarily intended to be exhaustive or to limit the invention to the exemplary embodiments disclosed. Any of the exemplary embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "upper", "below", "lower". "upward", "upwardly", "downward", "downwardly", "top", "bottom", "side", "vertical", "horizontal", "perpendicular" and "transverse" as well as any other similar directional terms refer to those directions of a vacuum cleaner in an upright position for use. Accordingly, these directional terms, as utilized to describe the vacuum cleaner should be interpreted relative to a vacuum cleaner in an upright position on a horizontal surface. The terms "left" and "right" are used to indicate the "right" when referencing from the right side as viewed from the rear of the vacuum cleaner, and the "left" when referencing from the left side as viewed from the rear of the vacuum cleaner.

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. A vacuum cleaner, comprising:

a base;

a motor configured to create flow through a suction path;

a first inlet and a second inlet disposed in the base in fluid communication with the suction path; and a first flexible member and a second flexible member connected to the base to cover the second inlet, the first and second flexible members being movable between first positions in which the second inlet is substantially covered to substantially prevent fluid from flowing through the second inlet and second positions in which fluid is allowed to flow through the second inlet, each of the first and second flexible members having a fixed end and a free end, the free ends of the first and second flexible members contacting each other in the first positions.

2. The vacuum cleaner of claim 1, wherein the first and second flexible members are movable to the second positions upon a suction force being exerted on the first and second flexible members causing movement thereof.

3. The vacuum cleaner of claim 1, wherein the first and second flexible members are made of a material selected from the group consisting of silicone, rubber, neoprene and polyurethane.

4. The vacuum cleaner of claim 1, wherein each of the first and second flexible members has a Shore A durometer between approximately 10 and approximately 90.

5. The vacuum cleaner of claim 1, wherein the first and second flexible members are substantially identical.

6. The vacuum cleaner of claim 1, wherein a third inlet is disposed in the base in fluid communication with the suction path; and a third flexible member and a fourth flexible member connected to the base to cover the third inlet, the third and fourth flexible members being movable between first positions in which the third inlet is substantially covered to substantially prevent fluid from flowing through the third inlet and second positions in which fluid is allowed to flow through the third inlet.

7. The vacuum cleaner of claim 6, wherein the first, second, third and fourth flexible members are substantially identical.

8. The vacuum cleaner of claim 1, wherein a surface agitator is rotatably disposed in the base.

9. The vacuum cleaner of claim 8, wherein the first and second flexible members are disposed forward of the surface agitator in a longitudinal direction of the base.

10. A vacuum cleaner, comprising:

a housing;

a suction path in fluid communication with the housing;

a base;

a motor configured to create flow through the suction path;

a first inlet and a second inlet disposed in the base in fluid communication with the suction path, the second inlet being disposed forward of the first inlet in a longitudinal direction of the base; and a first flexible member and a second flexible member connected to the base to cover the second inlet, the first and second flexible members being movable between first positions in which the second inlet is substantially covered to substantially prevent fluid from flowing through the second inlet and second positions in which fluid is allowed to flow through the second inlet, the first flexible member being configured to move in a first movement direction and the second flexible member being configured to move in a second movement direction, the second movement direction being opposite the first movement direction.

11. The vacuum cleaner of claim 10, wherein the first and second flexible members are movable to the second positions upon a suction force being exerted on the first and second flexible members causing movement thereof.

12. The vacuum cleaner of claim 10, wherein the base includes a frame and a cover plate connected to the frame, the second inlet being defined between the cover plate and the frame.

13. The vacuum cleaner of claim 12, wherein no portion of the frame is disposed directly beneath the second inlet.

14. The vacuum cleaner of claim 12, wherein the first flexible member is connected to the frame, and the second flexible member is connected to the cover plate.

15. The vacuum cleaner of claim 10, wherein each of the first and second flexible members has a fixed end and a free end, the free ends of the first and second flexible members contacting each other in the first positions.

16. The vacuum cleaner of claim 10, wherein the first and second flexible members are made of a material selected from the group consisting of silicone, rubber, neoprene and polyurethane.

17. The vacuum cleaner of claim 10, wherein each of the first and second flexible members has a Shore A durometer between approximately 10 and approximately 90.

18. The vacuum cleaner of claim 10, wherein the first flexible member contacts the second flexible member when the first and second flexible members are in the first positions.

19. A vacuum cleaner, comprising:

a housing;

a suction path in fluid communication with the housing;

a base;

a motor configured to create flow through the suction path;

a first inlet and a second inlet disposed in the base in fluid communication with the suction path, the second inlet being disposed forward of the first inlet in a longitudinal direction of the base; and a first flexible member and a second flexible member connected to the base to cover the second inlet, the first and second flexible members being movable between first positions in which the second inlet is substantially covered to substantially prevent fluid from flowing through the second inlet and second positions in which fluid is allowed to flow through the second inlet, the first flexible member contacting the second flexible member when the first and second flexible members are in the first positions.

20. The vacuum cleaner of claim 19, wherein each of the first and second flexible members has a Shore A durometer between approximately 10 and approximately 90.

* * * * *